US009918177B2

(12) United States Patent
Horbach

(10) Patent No.: US 9,918,177 B2
(45) Date of Patent: Mar. 13, 2018

(54) BINAURAL HEADPHONE RENDERING WITH HEAD TRACKING

(71) Applicant: Harman International Industries, Inc., Stamford, CT (US)

(72) Inventor: Ulrich Horbach, Canyon Country, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 90 days.

(21) Appl. No.: 14/982,490

(22) Filed: Dec. 29, 2015

(65) Prior Publication Data

US 2017/0188172 A1 Jun. 29, 2017

(51) Int. Cl.

| | |
|---|---|
| ***H04R 5/02*** | (2006.01) |
| ***H04S 7/00*** | (2006.01) |
| ***H04R 5/033*** | (2006.01) |
| ***H04S 3/00*** | (2006.01) |

(52) U.S. Cl.

CPC ..... *H04S 7/304* (2013.01); *H04R 5/0335* (2013.01); *H04S 3/008* (2013.01); *H04S 7/307* (2013.01); *H04S 2400/01* (2013.01); *H04S 2400/11* (2013.01); *H04S 2400/13* (2013.01); *H04S 2420/01* (2013.01); *H04S 2420/03* (2013.01)

(58) Field of Classification Search

CPC .... H04S 2420/01; H04S 5/0335; H04S 3/008; H04S 7/304; H04S 7/307; H04S 2420/03; H04S 2400/11; H04S 2400/13

See application file for complete search history.

(56) References Cited

U.S. PATENT DOCUMENTS

| | | | | |
|---|---|---|---|---|
| 5,717,767 | A | 2/1998 | Inanaga et al. | |
| 2002/0071661 | A1 | 6/2002 | Nakano et al. | |
| 2007/0154019 | A1* | 7/2007 | Kim | H04S 1/00 381/17 |
| 2012/0020502 | A1 | 1/2012 | Adams | |

(Continued)

FOREIGN PATENT DOCUMENTS

| | | | |
|---|---|---|---|
| GB | 2339127 | A | 1/2000 |
| JP | H09205700 | A | 5/1997 |

OTHER PUBLICATIONS

Partial European Search Report dated Apr. 6, 2017 in related European Patent Application No. 16203580.

(Continued)

*Primary Examiner* — Regina N Holder

(74) *Attorney, Agent, or Firm* — Brooks Kushman P.C.

(57) ABSTRACT

A sound enhancement system (SES) that can enhance reproduction of sound emitted by headphones and other sound systems is disclosed. The SES improves sound reproduction by simulating a desired sound system without including unwanted artifacts typically associated with simulations of sound systems. The SES facilitates such improvements by transforming sound system outputs through a set of one or more binaural rendering filters derived from direct and indirect head-related transfer functions (HRTFs). Parameters of the binaural rendering filters are updated based on the head tracking angle of user wearing the headphones to render a stable stereo sound image. The head tracking angle may be determined from sensor data obtained from a digital gyroscope mounted in a headphone assembly.

18 Claims, 6 Drawing Sheets

(56) References Cited

U.S. PATENT DOCUMENTS

| | | | |
|---|---|---|---|
| 2013/0243200 | A1 | 9/2013 | Horbach |
| 2015/0003649 | A1 | 1/2015 | Horbach |

OTHER PUBLICATIONS

K. Inanaga et al.; Headphone System With Out-Of-Head Localization Applying Dynamic HRTF; 98th AES Convention, Paris, Feb. 25-28, 1995, paper 4011; pp. 1-25.

U Horbach et al.; Design and Application of a Data-Based Auralization System for Surround Sound; 106th AES Convention, Munich Germany, May 8-11, 1999, paper 4976; pp. 1-25.

* cited by examiner

BINAURAL HEADPHONE RENDERING WITH HEAD TRACKING

TECHNICAL FIELD

The present disclosure relates to systems for enhancing audio signals, and more particularly to systems for enhancing sound reproduction over headphones.

BACKGROUND

Advancements in the recording industry include reproducing sound from a multiple channel sound system, such as reproducing sound from a surround sound system. These advancements have enabled listeners to enjoy enhanced listening experiences, especially through surround sound systems such as 5.1 and 7.1 surround sound systems. Even two-channel stereo systems have provided enhanced listening experiences through the years.

Typically, surround sound or two-channel stereo recordings are recorded and then processed to be reproduced over loudspeakers, which limits the quality of such recordings when reproduced over headphones. For example, stereo recordings are usually meant to be reproduced over loudspeakers, instead of being played back over headphones. This results in the stereo panorama appearing on line in between the ears or inside a listener's head, which can be an unnatural and fatiguing listening experience.

To resolve the issues of reproducing sound over headphones, designers have derived stereo and surround sound enhancement systems for headphones; however, for the most part these enhancement systems have introduced unwanted artifacts such as unwanted coloration, resonance, reverberation, and/or distortion of timbre or sound source angle and/or position.

SUMMARY

One or more embodiments of the present disclosure are directed to a method for enhancing reproduction of sound. The method may include receiving an audio input signal at a first audio signal interface and receiving an input indicative of a head rotational angle from a digital gyroscope mounted to a headphone assembly. The method may further include updating at least one binaural rendering filter in each of a pair of parametric head-related transfer function (HRTF) models based on the head rotational angle and transforming the audio input signal to an audio output signal using the at least one binaural rendering filter. The audio output signal may include a left headphone output signal and a right headphone output signal.

According to one or more embodiments, receiving input indicative of a head rotational angle may comprise receiving an angular velocity signal from the digital gyroscope mounted to the headphone assembly and calculating the head rotational angle from the angular velocity signal when the angular velocity signal exceeds a predetermined threshold or is less than the predetermined threshold for less than a predetermined sample count. Alternately, receiving input indicative of a head rotational angle may comprise receiving an angular velocity signal from the digital gyroscope mounted to the headphone assembly and calculating the head rotational angle as a fraction of a previous head rotational angle measurement when the angular velocity signal is less than a predetermined threshold for more than a predetermined sample count.

According to one or more embodiments, the audio input signal is a multi-channel audio input signal. Alternatively, the audio input signal may be a mono-channel audio input signal.

According to one or more embodiments, updating the at least one binaural rendering filter based on the head rotational angle may comprise retrieving parameters for the at least one binaural rendering filter from at least one look-up table based on the head rotational angle. Further, retrieving parameters for the at least one binaural rendering filter from the at least one look-up table based on the head rotational angle may comprise generating a left table pointer index value and a right table pointer index value based on the head rotational angle and retrieving the parameters for the at least one binaural rendering filter from the at least one look-up table based on the left table pointer index value and the right table pointer index value.

According to one or more embodiments, the at least one binaural rendering filter may comprise a shelving filter and a notch filter. Further, updating at least one binaural rendering filter based on the head rotational angle may include updating a gain parameter for each of the shelving filter and the notch filter based on the head rotational angle. The at least one binaural rendering filter may further comprise an inter-aural time delay filter. Moreover, updating at least one binaural rendering filter based on the head rotational angle may comprise updating a delay value for the inter-aural time delay filter based on the head rotational angle.

One or more additional embodiments of the present disclosure relate to a system for enhancing reproduction of sound. The system may comprise a headphone assembly including a headband, a pair of headphones, and a digital gyroscope. The system may further comprise a sound enhancement system (SES) for receiving an audio input signal from an audio source. The SES may be in communication with the digital gyroscope and the pair of headphones. The SES may include a microcontroller unit (MCU) configured to receive an angular velocity signal from the digital gyroscope and to calculate a head rotational angle from the angular velocity signal. The SES may further include a digital signal processor (DSP) in communication with the MCU. The DSP may include a pair of dynamic parametric head-related transfer function (HRTF) models configured to transform the audio input signal to an audio output signal. The pair of dynamic parametric HRTF models may have at least a cross filter, wherein at least one parameter of the cross filter is updated based on the head rotational angle.

According to one or more embodiments, the cross filter may comprise a shelving filter and a notch filter. The at least one parameter of the cross filter may include a shelving filter gain and a notch filter gain. The pair of dynamic parametric HRTF models may further include an inter-aural time delay filter having a delay parameter, wherein the delay parameter is updated based on the head rotational angle.

The MCU may also be configured to calculate a table pointer index value based on the head rotational angle. Moreover, the at least one parameter of the cross filter may be updated using a look-up table according to the table pointer index value. The MCU may be further configured to calculate the head rotational angle from the angular velocity signal when the angular velocity signal exceeds a predetermined threshold or is less than the predetermined threshold for less than a predetermined sample count. The MCU may also be further configured to gradually decrease the head rotational angle when the angular velocity signal is less than a predetermined threshold for more than a predetermined sample count.

One or more additional embodiments of the present disclosure relate to a sound enhancement system (SES) comprising a processor, a distance renderer module, a binaural rendering module, and an equalization module. The distance renderer module may be executable by the processor to receive at least a left-channel audio input signal and a right-channel audio input signal from an audio source. The distance renderer module may be further executable by the processor to generate at least a delayed image of the left-channel audio input signal and the right-channel audio input signal.

The binaural rendering module, executable by the processor, may be in communication with the distance renderer module. The binaural rendering module may include at least one pair of dynamic parametric head-related transfer function (HRTF) models configured to transform the delayed image of the left-channel audio input signal and the right-channel audio input signal to a left headphone output signal and a right headphone output signal. The pair of dynamic parametric HRTF models may have a shelving filter, a notch filter and an inter-aural time delay filter. At least one parameter from each of the shelving filter, the notch filter and the time delay filter may be updated based on a head rotational angle.

The equalization module, executable by the processor, may be in communication with the binaural rendering module. The equalization module may include a fixed pair of equalization filters configured to equalize the left headphone output signal and the right headphone output signal to provide a left equalized headphone output signal and a right equalized headphone output signal.

According to one or more embodiments, a gain parameter for each of the shelving filter and the notch filter may be updated based on the head rotational angle. Further, a delay value for the time delay filter may be updated based on the head rotational angle.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
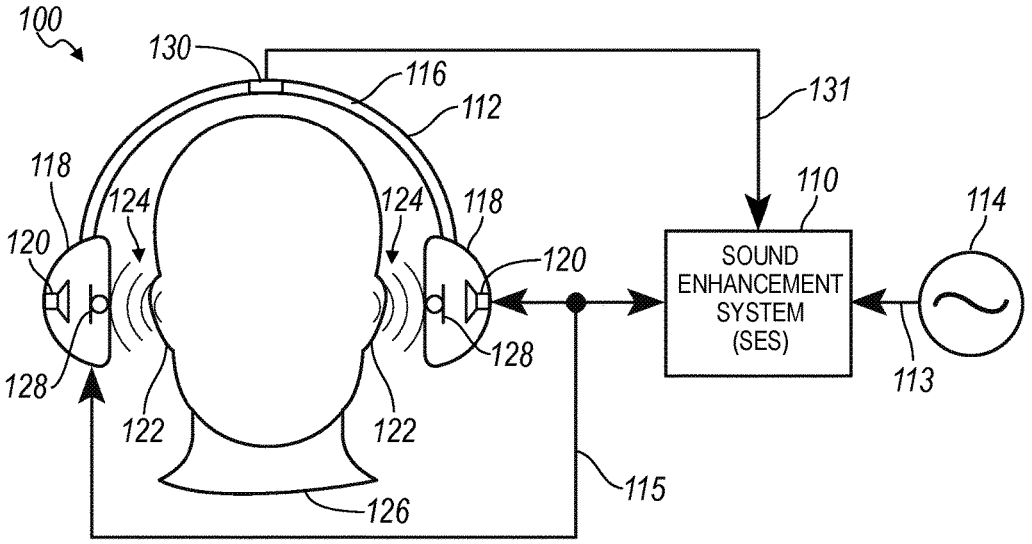
FIG. 1 is a simplified, exemplary schematic diagram illustrating a sound enhancement system connected to a headphone assembly for improving sound reproduction, according to one or more embodiments of the present disclosure.

With reference to FIG. 1, a sound system 100 for enhancing reproduction of sound is illustrated in accordance with one or more embodiments of the present disclosure. The sound system 100 may include a sound enhancement system (SES) 110 connected (e.g., by a wired or wireless connection) to a headphone assembly 112. The SES 110 may receive an audio input signal 113 from an audio source 114 and may provide an audio output signal 115 to the headphone assembly 112. The headphone assembly 112 may include a headband 116 and a pair of headphones 118. Each headphone 118 may include a transducer 120, or driver, that is positioned in proximity to a user's ear 122. The headphones may be positioned on top of a user's ears (supra-aural), surrounding a user's ears (circum-aural) or within the ear (intra-aural). The SES 110 provides audio output signals to the headphone assembly 112, which are used to drive the transducers 120 to generate audible sound in the form of sound waves 124 to a user 126 wearing the headphone assembly 112. Each headphone 118 may also include one or more microphones 128 that are positioned between the transducer 120 and the ear 122. According to one or more embodiments, the SES 110 may be integrated within the headphone assembly 112, such as in the headband 116 or one of the headphones 118.

The SES 110 can enhance reproduction of sound emitted by the headphones 118. The SES 110 improves sound reproduction by simulating a desired sound system without including unwanted artifacts typically associated with simulations of sound systems. The SES 110 facilitates such improvements by transforming sound system outputs through a set of one or more sum and/or cross filters, where such filters have been derived from a database of known direct and indirect head-related transfer functions (HRTFs), also known as ipsilateral and contralateral HRTFs, respectively. A head-related transfer function is a response that characterizes how an ear receives a sound from a point in space. A pair of HRTFs for two ears can be used to synthesize a binaural sound that seems to come from a particular point in space. For instance, the HRTFs may be designed to render sound sources in front of a listener at ±45 degrees.

In headphone implementations, eventually the audio output signal 115 of the SES 110 are direct and indirect HRTFs, and the SES 110 can transform any mono- or multi-channel audio input signal into a two-channel signal, such as a signal for the direct and indirect HRTFs. Also, this output can maintain stereo or surround sound enhancements and limit unwanted artifacts. For example, the SES 110 can transform an audio input signal, such as a signal for a 5.1 or 7.1 surround sound system, to a signal for headphones or another type of two-channel system. Further, the SES 110 can perform such a transformation while maintaining the enhancements of 5.1 or 7.1 surround sound and limiting unwanted amounts of artifacts.

The sound waves 124, if measured at the user 126, are representative of a respective direct HRTF and indirect HRTF produced by the SES 110. For the most part, the user 126 receives the sound waves 124 at each respective ear 122 by way of the headphones 118. The respective direct and indirect HRTFs that are produced from the SES 110 are specifically a result of one or more sum and/or cross filters of the SES 110, where the one or more sum and/or cross filters are derived from known direct and indirect HRTFs. These sum and/or cross filters, along with inter-aural delay filters, may be collectively referred to as binaural rendering filters.

The headphone assembly 112 may also include a sensor 130, such as a digital gyroscope. The sensor 30 may be mounted on top of the headband 116, as shown in FIG. 1. Alternatively, the sensor 30 may be mounted in one of the headphones 118. By means of the sensor 130, the binaural rendering filters of the SES 110 can be updated in response to head rotation, as indicated by feedback path 131. The binaural rendering filters may be updated such that the resulting stereo image remains stable while turning the head. This provides an important directional cue to the brain, indicating that the sound image is located in front or in the back. As a result, so-called "front-back confusion" may be eliminated. In natural spatial hearing situations, a person performs mostly unconscious, spontaneous, small head movements to help with localizing sound. Including this effect in headphone reproduction can lead to a greatly improved three-dimensional audio experience with convincing out-of-the-head imaging.

The SES 110 may include a plurality of modules. The term "module" may be defined to include a plurality of executable modules. As described herein, the modules are defined to include software, hardware or some combination of hardware and software that is executable by a processor, such as a digital signal processor (DSP). Software modules may include instructions stored in memory that are executable by the processor or another processor. Hardware modules may include various devices, components, circuits, gates, circuit boards, and the like that are executable, directed, and/or controlled for performance by the processor.

Figure 2:
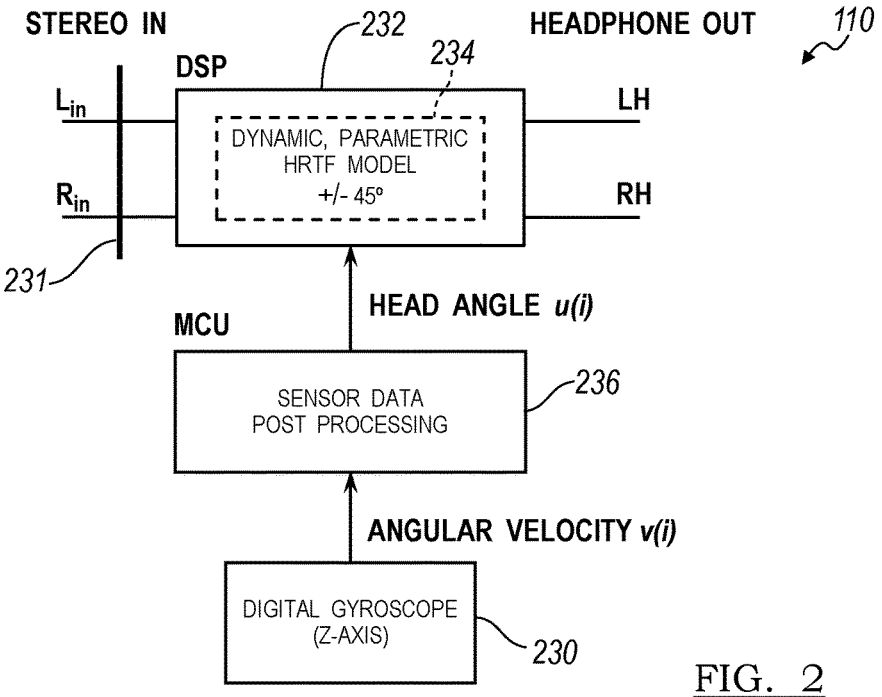
FIG. 2 is simplified, exemplary block diagram of a sound enhancement system, according to one or more embodiments of the present disclosure.

FIG. 2 is a schematic block diagram of the SES 110. The SES 110 may include an audio signal interface 231 and a digital signal processor (DSP) 232. The audio signal interface 231 may receive the audio input signal 113 from the audio source 114, which may then be fed to the DSP 232. The audio input signal 113 may be a two-channel stereo signal having a left-channel audio input signal $L_{in}$ and a right channel audio input signal $R_{in}$. A pair of parametric models of head-related transfer functions 234 may be implemented in the DSP 232 to generate a left headphone output signal LH and right headphone output signal RH. As previously explained, a head-related transfer function (HRTF) is a response that characterizes how an ear receives a sound from a point in space. A pair of HRTFs for two ears can be used to synthesize a binaural sound that seems to come from a particular point in space. For instance, the HRTFs 234 may be designed to render sound sources in front of the listener (e.g., at ±30 degrees or ±45 degrees relative to the listener).

According to one or more embodiments, the pair of HRTFs 234 may also be dynamically updated in response to the head rotational angle u(i), where i=sampled time index. In order to dynamically update the pair of HRTFs, the SES 110 may also include the sensor 130, which may be a digital gyroscope 230 as shown in FIG. 2. As set forth previously, the digital gyroscope 230 may be mounted on top of the headband 116 of the headphone assembly 112. The digital gyroscope 230 may generate a time-sampled, angular velocity signal v(i) indicative of a user's head movement using, for example, the z-axis component from the gyroscope's measurement. A typical update rate for the angular velocity signal v(i) may be 5 milliseconds, which corresponds to a sample rate of 200 Hz. However, other update rates may be employed in the 0 to 40 millisecond range. The response time to head rotations (i.e., latency) should not exceed 10-20 milliseconds in order to maintain natural sound and to generate the desired out-of-head experience, which refers to the sensation of sound emanating from a point in space.

The SES 110 may further include a microcontroller unit (MCU) 236 to process the angular velocity signal v(i) from the digital gyroscope 230. The MCU 236 may contain software to post process the raw velocity data received from the digital gyroscope 230. The MCU 236 may further provide a sample of the head rotational angle u(i) at each time instant i based on the post-processed velocity data extracted from the angular velocity signal v(i).

Figure 3:
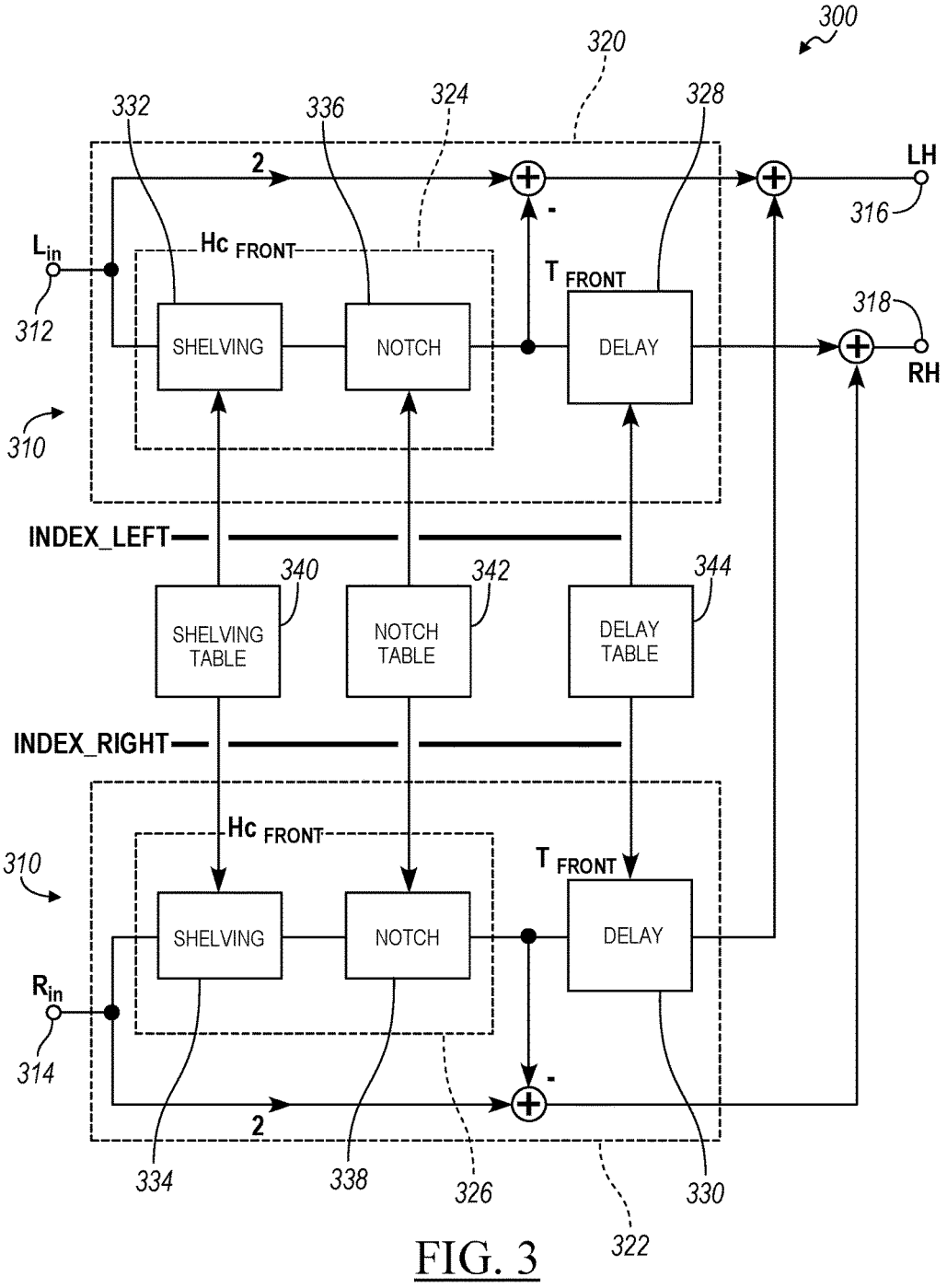
FIG. 3 is an exemplary signal flow diagram of a binaural rendering module, according to one or more embodiments of the present disclosure.

Referring to FIG. 3, an implementation of the dynamic, parametric HRTF model in accordance with one or more embodiments of the present disclosure is shown in greater detail. In particular, FIG. 3 is a signal flow diagram of a binaural rendering module 300 of an embodiment of the SES 110 having binaural rendering filters 310 for transforming an audio signal. The binaural rendering module 300 enhances the naturalness of music reproduction over the headphones 118. The binaural rendering module 300 includes a left input 312 and a right input 314 that are connected to an audio source (not shown) for receiving audio input signals, such as the left-channel audio input signal $L_{in}$ and the right-channel audio input signal $R_{in}$, respectively. The binaural rendering module 300 filters the audio input signals, as described in detail below. The binaural rendering module 300 includes a left output 316 and a right output 318 for providing audio signals, such as the left headphone output signal LH and the right headphone output signal RH, to drive the transducers 120 of the headphone assembly 112 (shown in FIG. 1) to provide audible sound to the user 126. The binaural rendering module 300 may be combined with other audio signal processing modules, such as a distance renderer module and an equalization module, to further filter the audio signals before providing them to the headphone assembly 112.

The binaural rendering module 300 may include a left-channel head-related filter (HRTF) 320 and a right-channel head-related filter (HRTF) 322, according to one or more embodiments. Each HRTF filter 320, 322 may include an inter-aural cross function ($Hc_{front}$) 324, 326 and an inter-aural time delay ($T_{front}$ 328, 330, respectively, corresponding to frontal sound sources, thereby emulating a pair of loudspeakers in front of the listener (e.g., at ±30° or ±45° relative to the listener). In other embodiments, the binaural rendering module 300 also includes HRTFs that correspond to side and rear sound sources. The design of the binaural rendering module 300 is described in detail in U.S. application Ser. No. 13/419,806 to Horbach, filed Mar. 14, 2012, and published as U.S. Patent Appl. Pub. No. 2013/0243200 A1, which is incorporated by reference in its entirety herein.

The signal flow in FIG. 3 is similar to that described in U.S. application Ser. No. 13/419,806 for the static case, which involves no head tracking. Two second-order filter sections may be used in each cross path ($Hc_{front}$) 324, 326, a variable shelving filter 332, 334 and a variable notch filter 336, 338. The shelving filter 332, 334 may include the parameters "f" (representing corner frequency), "Q" (representing quality factor), and "α" (representing shelving filter gain in dB). The notch filter 336, 338 may include the parameters "f" (representing notch frequency), "Q" (representing quality factor), and "α" (representing notch filter gain in dB). The inter-aural time delay filter ($T_{front}$) 328, 330 is employed to simulate the path difference between left and right ear. Specifically, the delay filter 328, 330 simulates the time a sound wave takes to reach one ear after it first reaches the other ear.

In the static case of fixed rendering at an angle 45 degrees relative to the listener, the parameters as set forth in U.S. application Ser. No. 13/419,806 may be:

Shelving filter: Q=0.7, f=2500 Hz, α=−14 dB;

Notch filter: Q=1.7, f=1300 Hz, α=−10 dB; and

Delay value: 17 samples.

In the dynamic case, according to one or more embodiments, the range of head movements may be limited to ±45 degrees in order to reduce complexity. For example, moving the head towards a source at 45 degrees will lower the required rendering angle from 45 degrees down to 0 degrees, while moving the head away from the source will increase the angle up to 90 degrees. Beyond these angles, the binaural rendering filters may stay at their extreme positions, either 0 degrees or 90 degrees. This limitation is acceptable because the main purpose of head tracking according to one or more embodiments of the present disclosure is to process small, spontaneous head movements, thereby providing a better out-of-head localization.

As shown in FIG. 3, the parameters for each shelving filter, notch filter, and delay filter may be updated according to respective look-up tables based on head movement. Specifically, the dynamic, binaural rendering module 300 may include a shelving table 340, a notch table 342, and a delay table 344 having filter parameters for different head angles. For instance, a 90 degree HRTF model may use the same shelving filter parameters Q and f, but with increased attenuation (e.g., gain α=−20 dB). This may allow smooth steering of filter coefficients by table lookup, without the need to move filter pole locations, which would introduce audible clicks. According to one or more embodiments, the shelving and notch filters may be implemented as digital biquad filters whose transfer function is the ratio of two quadratic functions. The biquad implementation of the shelving and notch filters contains three feed forward coefficients represented in the numerator polynomial and the two feedback coefficient represented in the denominator polynomial. The denominator defines the location of the poles, which may be fixed in this implementation, as previously stated. Accordingly, only the three feed forward coefficients of the filters need to be switched.

The head rotational angle u(i), once determined, may be used to generate a left table pointer index (index_left) and a right table pointer index (index_right). The left and right table pointer index values may then be used to retrieve the shelving, notch, and delay filter parameters from the respective filter look-up tables. For a steering angle u=−44.5 . . . +45 and angular resolution of 0.5 degrees, the left and right table pointer indices are:

$$\text{index_left}=\text{round}[2*(u+45)] \quad \text{Eq. 1}$$

$$\text{index_right}=181-\text{index_left} \quad \text{Eq. 2}$$

Accordingly, if the head moves towards a left source, it moves away from a right source, and vice versa.

Figure 4A:
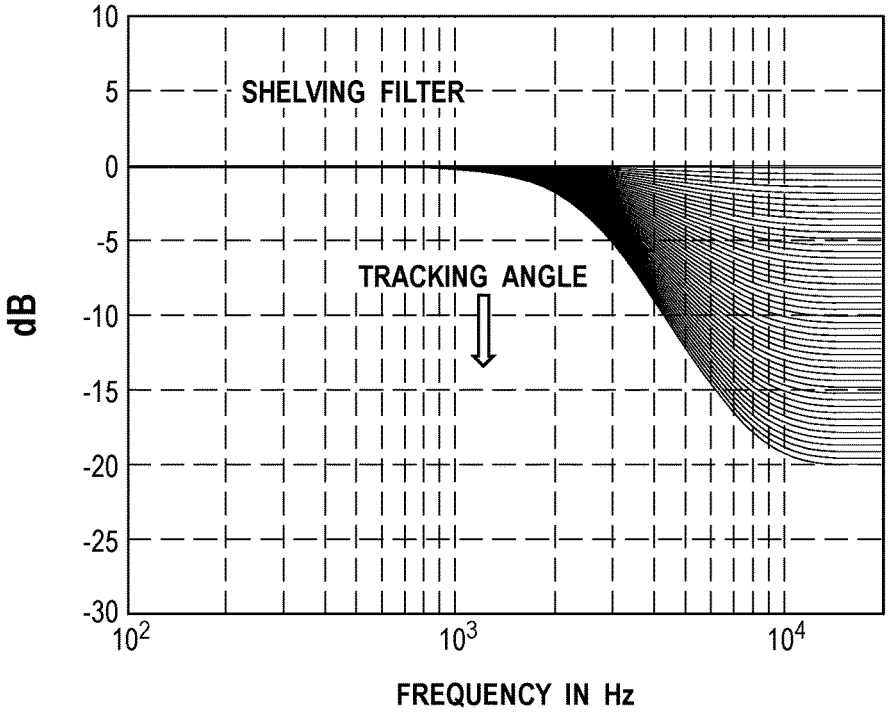
FIG. 4*a* is a graph showing a set of frequency responses for a variable shelving filter, according to one or more embodiments of the present disclosure.
Figure 4B:
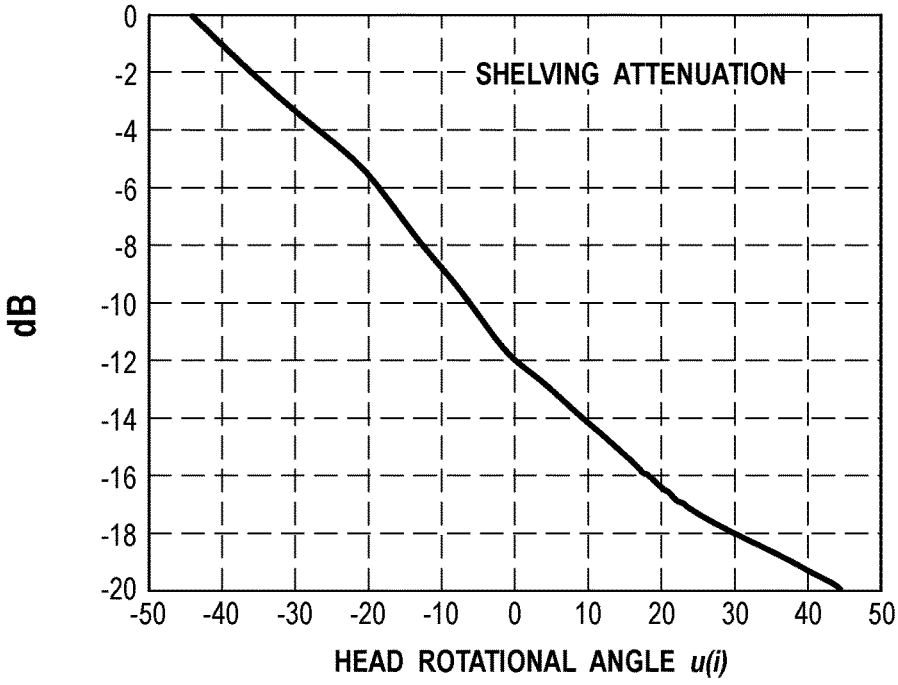
FIG. 4*b* is a graph showing the mapping of head tracking angle to shelving attenuation, according to one or more embodiments of the present disclosure.

FIG. 4*a* shows a set of frequency responses (total 180 curves) for the variable shelving filter 332, 334 that are active when the head rotational angle u(i) moves from −45 degrees to +45 degrees. The mapping of head rotational angle u(i) to shelving attenuation may be nonlinear, as shown in FIG. 4*b*. A stepwise linear function (polygon) was used in this example, which was optimized empirically, by comparing the perceived image with the intended one. Other functions such as linear or exponential functions may also be employed.

Figure 5A:
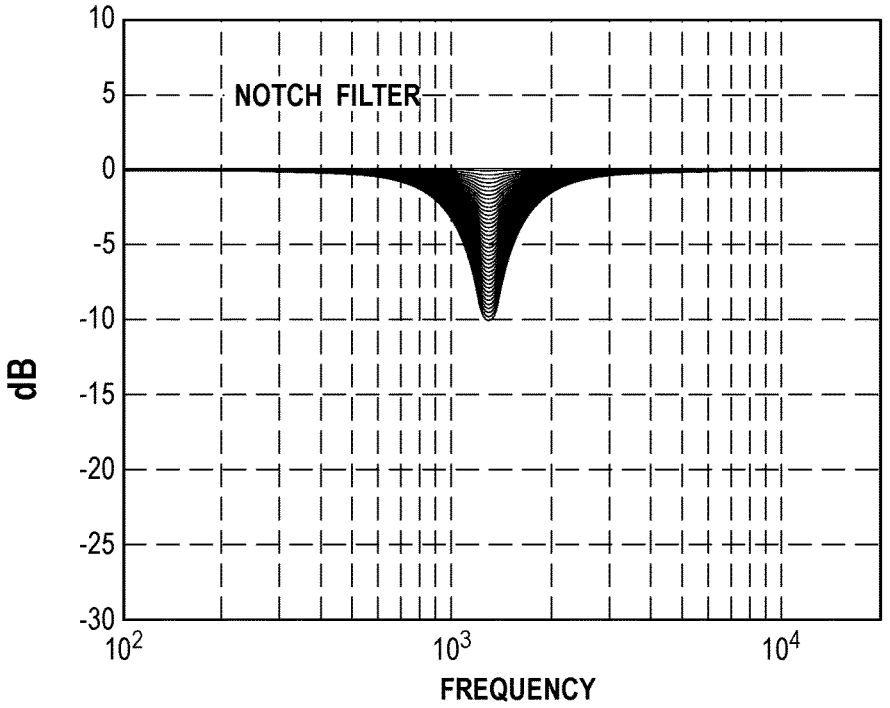
FIG. 5*a* is a graph showing a set of frequency responses for a variable notch filter, according to one or more embodiments of the present disclosure.
Figure 5B:
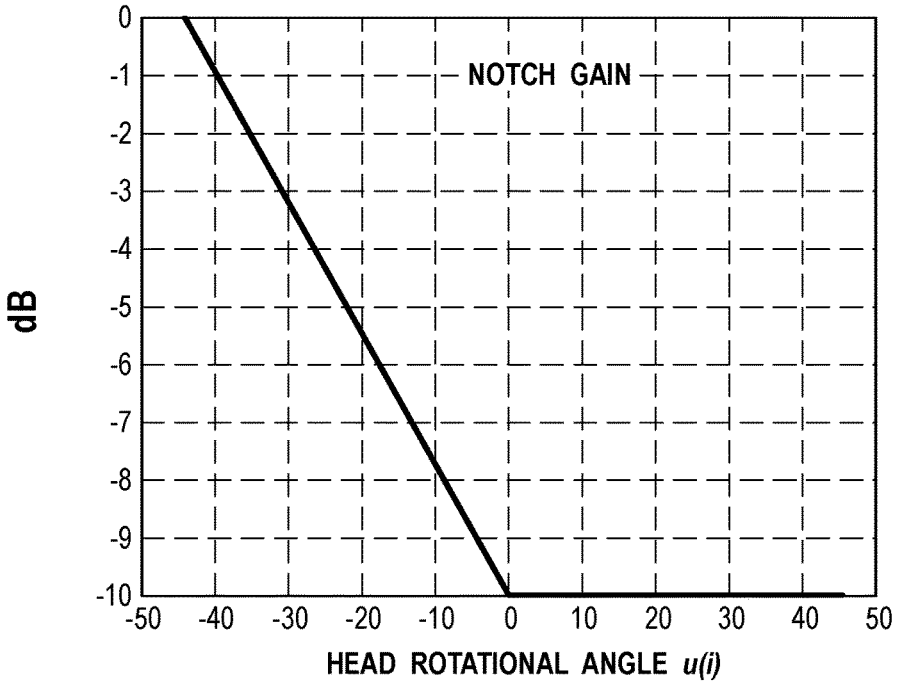
FIG. 5*b* is a graph showing the mapping of head tracking angle to notch gain, according to one or more embodiments of the present disclosure.

Similarly, the notch filter 336, 338 may be steered by its gain parameter "α" only, as shown in FIG. 5*b*. The other two parameters, Q and f, may also remain fixed. FIG. 5*a* shows the resulting set of frequency responses (total 180 curves) for the variable notch filter 336, 338 that are active when the head rotational angle u(i) moves from −45 degrees to +45 degrees. As shown in FIG. 5*b*, the notch filter gain "α" may vary from 0 dB at u=−45 to −10 dB at u=zero (i.e., nominal head position). The notch filter gain "α" may then stay at −10 dB for positive head rotational angles. This mapping has been empirically verified.

Figure 6:
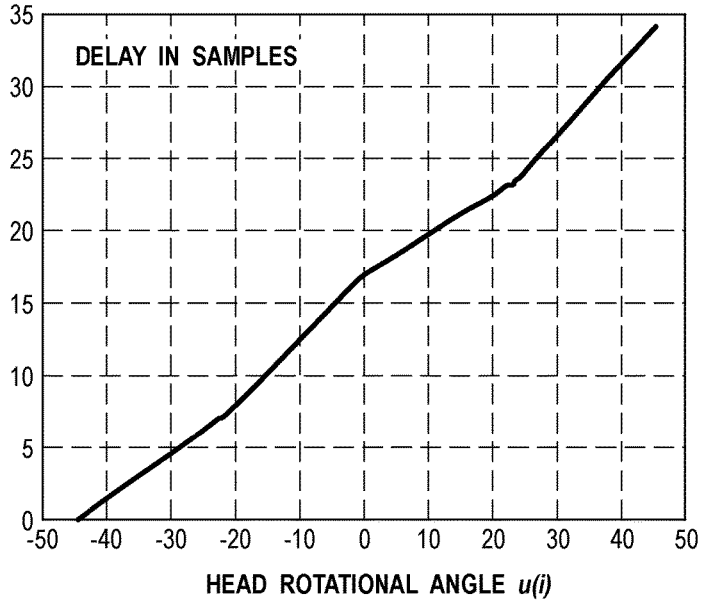
FIG. 6 is a graph showing the mapping head tracking angle to delay values, according to one or more embodiments of the present disclosure.

The delay filter values may be steered by the variable delay table 344 between 0 and 34 samples, using a mapping as shown in FIG. 6. Non-integer delay values may be rendered by linear interpolation between adjacent delay line taps, using scaling coefficients c and (1-c), where c is the fractional part of the delay value, and then summing the two scaled signals.

Figure 7:
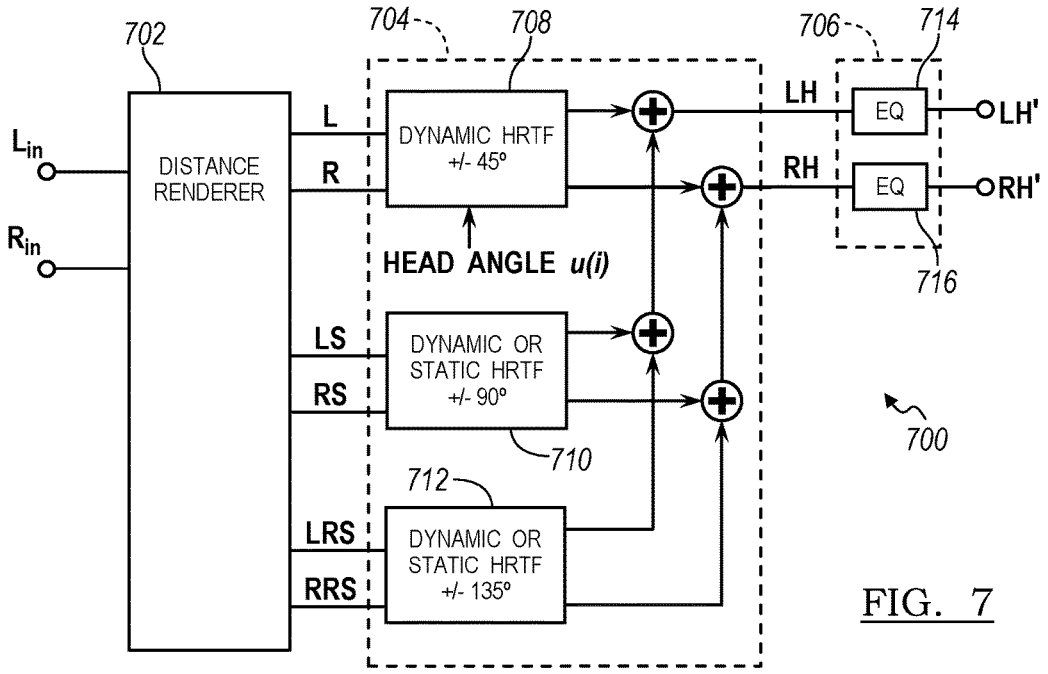
FIG. 7 is an exemplary signal flow diagram of a sound enhancement system including a distance renderer module, a binaural rendering module and an equalization module, according to one or more embodiments of the present disclosure.

FIG. 7 is a block diagram depicting an exemplary headphone rendering module 700 with head tracking according to one or more embodiments of the SES 110. The module 700 may use an additional distance rendering stage, as described in U.S. application Ser. No. 13/419,806, which has been incorporated by reference. The module 700 combines a distance renderer module 702 with a parametric binaural rendering module 704 (such has the module 300 of FIG. 3) and a headphone equalizer module 706. Specifically, the module 700 may transform two-channel audio (where surround sound signals may be simulated) to direct and indirect HRTFs for headphones. The module 700 could also be implemented for transformation of audio signals from multichannel surround to direct and indirect HRTFs for headphones. In this instance, the module 700 may include six initial inputs, and right and left outputs for headphones.

With respect to the distance and location rendering, the binaural model of the module 704 provides directional information, but sound sources may still appear very close to the head of a listener. This may especially be the case if there is not much information with respect to the location of the sound source (e.g., dry recordings are typically perceived as being very close to the head or even inside the head of a listener). The distance renderer module 702 may limit such unwanted artifacts. The distance renderer module 702 may include two delay lines, one per each of the initial left and right-channel audio input signals, $L_{in}$, $R_{in}$, respectively. In other embodiments of the SES, one or more than two tapped delay lines can be used. For example, six tapped delay lines may be used for a 6-channel surround signal.

By means of long, tapped delay lines, delayed images of the left- and right-channel audio input signals L, R may be generated and fed to simulated sources around the head, located at ±90 degrees (left surround, LS, and right surround, RS) and ±135 degrees (left rear surround, LRS, and right rear surround, RRS), respectively. Accordingly, the distance renderer module 702 may provide six outputs, representing the left- and right-channel input signals L, R, left and right surround signals LS, RS, and left and right rear surround signals LRS, RRS.

The binaural rendering module 704 may include a dynamic, parametric HRTF model 708 for rendering sound sources in front of a listener at ±45 degrees. Additionally, the parametric binaural rendering module 704 may include additional surround HRTFs 710, 712 for rendering the simulated sound sources at ±90 degrees and ±135 degrees. Alternatively, one or more embodiments of the SES 110 could employ other HRTFs for sources that have other source angles, such as 80 degrees and 145 degrees. These surround HRTFs 710, 712 may simulate a room environment with discrete reflections, which results in sound images perceived farther away from the head (distance rendering). The reflections, however, do not necessarily need to be steered by the head rotational angle u(i). Both options, static and dynamic, are possible, as illustrated in FIG. 7. The binaural rendering module 704 may transform the audio signals received from the distance renderer module 702 using the HRTFs to generate the left headphone output signal LH and the right headphone output signal RH.

Further, FIG. 7 illustrates a headphone equalization module 706 including a fixed pair of equalization filters 714, 716 that may equalize the outputs of the HRTFs, namely the left headphone output signal LH and the right headphone output signal RH. The headphone equalizer module 706, which follows the parametric binaural module 704, may further reduce coloration and improve quality of rendered HRTFs and localization. Accordingly, the headphone equalizer module 706 may equalize the left headphone output signal LH and the right headphone output signal RH to provide a left equalized headphone output signal LH' and the right equalized headphone output signal RH'.

Figure 8:
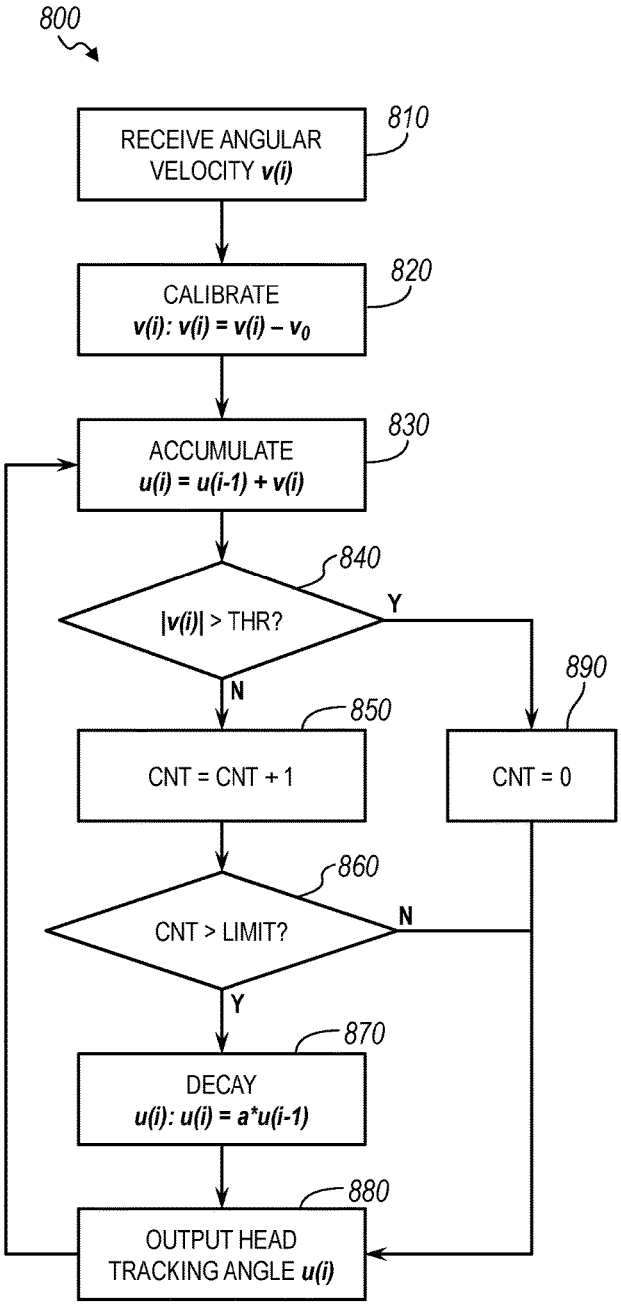
FIG. 8 is a flow chart illustrating a method for enhancing the reproduction of sound, according to one or more embodiments of the present disclosure.

FIG. 8 is a flow chart illustrating a method 800 for enhancing the reproduction of sound, according to one or more embodiments. In particular, FIG. 8 illustrates a post processing algorithm that may be implemented in a microcontroller, such as the MCU 236. At step 810, the MCU 236 may receive an angular velocity signal v(i) (where i=time index) from the digital gyroscope 230. As previously explained, only the z-axis component of the angular velocity signal v(i) may be used for head tracking. In addition to the angular velocity signal v(i), the MCU 236 may also receive an unwanted offset $v_0$, which may slowly drift over time. At step 820, the MCU 236 may perform a calibration procedure at startup. The calibration procedure may be performed each time the headphone assembly is powered up. Alternatively, the calibration procedure may be performed less frequently, such as once in the factory when, for example, triggered by a command through service software. The calibration procedure may measure the offset as an average over v(i) if the condition "headphone not in motion" is met (i.e., the MCU 236 determines that the headphone assembly 112 is not moving). During calibration, the headphone assembly 112 must be held still for a short period of time (e.g., 1 second) after power-up.

After calibration, the head rotational angles u(i) may be generated in a loop by accumulating the elements of the velocity vector from the angular velocity signal v(i), according to the following equation, as shown at step 830:

$$u(i)=u(i-1)+v(i) \quad \text{Eq. 3}$$

According to one or more embodiments, the loop may contain a threshold detector, which compares the absolute values of the angular velocity signal v(i) with a predetermined threshold, THR. Thus, at step 840, the MCU 236 may determine whether the absolute value of v(i) is greater than the threshold, THR.

If the absolute values of the angular velocity signal v(i) are below the threshold for a contiguous number of samples (e.g., a sample count exceeds a predetermined limit), then the MCU 236 may assume the sensor in the digital gyroscope 230 is not in motion. Thus, if the result of step 840 is NO, the method may proceed to step 850. At step 850, a sample counter (cnt) may be incremented by 1. At step 860, the MCU 236 may determine whether the sample counter exceeds a predetermined limit representing the contiguous number of samples. If the condition at step 860 is met, the head rotational angle u(i) may be gradually ramped down to zero at step 870 by the following equation:

$$u(i)=a*u(i-1), \text{ where } a<1 \text{ (e.g., } a=0.995) \quad \text{Eq. 4}$$

This causes the SES 110 to automatically move the acoustic image back to its normal position in front of the head of the headphone user 126, thereby ignoring any remaining long-term drift of the sensor in the digital gyroscope 230. According to one or more embodiments, the hold time (defined by the limit counter) and the decay time may be in the order of a few seconds.

The head rotational angle u(i) resulting from step 870 may be output at step 880. If, on the other hand, the condition at step 860 is not met, the method may proceed directly to step 880, where the head rotational angle u(i) calculated at step 830 may be output.

Returning to step 840, if the absolute value of the angular velocity signal v(i) is above the threshold (THR), the MCU 236 may determine that the sensor in the digital gyroscope 230 is in motion. Accordingly, if the result at step 840 is YES, then the method may proceed to step 890. At step 890, the MCU 236 may reset the sample counter (cnt) to zero. The method may then proceed to step 880, where the head rotational angle u(i) calculated at step 830 may be output. Therefore, whether the headphone assembly 112 is determined to be in motion or not, the head rotational angle u(i) ultimately may be output at step 880 or otherwise used for updating the parameters of the shelving filters 332, 334, the notch filters 336, 338, and the delay filters 328, 330.

Figure 9:
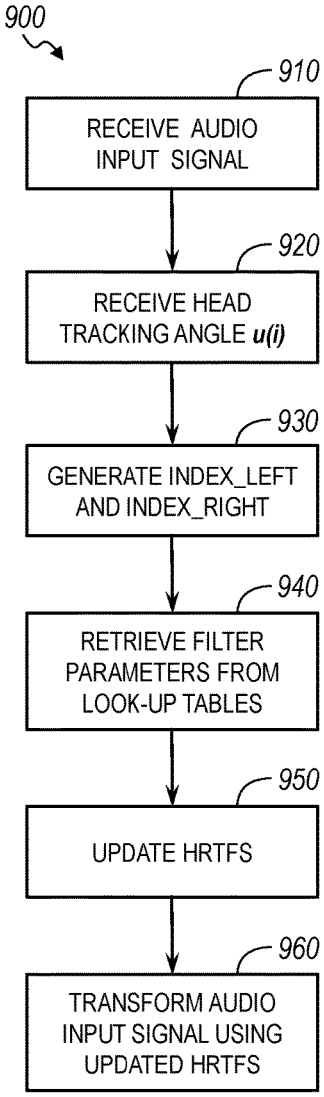
FIG. 9 is another flow chart illustrating a method for enhancing the reproduction of sound, according to one or more embodiments of the present disclosure.

With reference now to FIG. 9, another flow chart illustrating a method 900 for further enhancing the reproduction of sound is depicted, according to one or more embodiments. In particular, FIG. 9 illustrates a post processing algorithm that may be implemented in a microcontroller, such as the MCU 236, or in a digital signal processor, such as the DSP 232, or in a combination of both processing devices. FIG. 9 specifically shows a method for updating the HRTF filters based on the head rotational angle u(i) ascertained from the method 800 described in connection with FIG. 8 and further transforming an audio input signal based on the updated HRTFs.

At step 910, the SES may receive audio input signals at the audio signal interface 231, which may be fed to the DSP 232. As explained with respect to FIG. 8, the MCU 236 may continuously determine the head rotational angle u(i) from the angular velocity signal v(i) obtained from the digital gyroscope 230. At step 920, the MCU 236 or the DSP 232 may retrieve or receive the head rotational angle u(i). At step 930, the new head rotational angle u(i) may then be used to generate the left table pointer index (index_left) and the right table pointer index (index_right). As previously described, the left and right table pointer index values may be calculated from Equation 1 and Equation 2, respectively. The left and right table pointer index values may be used to look up filter parameters. For example, at step 940, the left and right table pointer index values may then be used to retrieve the shelving, notch, and delay filter parameters from their respective filter look-up tables.

According to one or more embodiments, only the gain parameter "α" of the shelving and notch filters may vary with a change in the left and right table pointer index values. Further, only the number of samples taken by the delay filter may vary with a change in the left and right table pointer index values. According to one or more alternative embodiments, other filter parameters, such as the quality factor "Q" or the shelving/notch frequency "f," may also vary with a change in the left and right table pointer index values.

Once the shelving, notch, and delay filter parameters are retrieved from their look-up tables, the DSP 232 may update the respective shelving filter 332, 334, notch filter 3346, 338, and delay filter 328, 330 for the dynamic, parametric HRTFs 320, 322 of the binaural rendering module 300 at step 950. At step 960, the DSP 232 may transform the audio input signal 113 received from the audio source 114 using the updated HRTFs to an audio output signal including a left headphone output signal LH and a right headphone output signal RH. Updating these binaural rendering filters 310 in response to head rotation results in stereo image that remains stable while turning the head. This provides an important directional cue to the brain, indicating that the sound image is located in front or in the back. As a result, so-called "front-back confusion" may be eliminated.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for enhancing reproduction of sound comprising:

receiving an audio input signal at a first audio signal interface;

receiving an angular velocity signal from the digital gyroscope mounted to the headphone assembly;

calculating a head rotational angle as a fraction of a previous head rotational angle measurement when the angular velocity signal is less than a predetermined threshold for more than a predetermined sample count;

updating at least one binaural rendering filter in each of a pair of parametric head-related transfer function (HRTF) models based on the head rotational angle; and transforming the audio input signal to an audio output signal using the at least one binaural rendering filter, the audio output signal including a left headphone output signal and a right headphone output signal.

2. The method of claim 1, wherein the audio input signal is a multi-channel audio input signal.

3. The method of claim 1, wherein the audio input signal is a mono-channel audio input signal.

4. The method of claim 1, wherein updating the at least one binaural rendering filter based on the head rotational angle comprises retrieving parameters for the at least one binaural rendering filter from at least one look-up table based on the head rotational angle.

5. The method of claim 4, wherein retrieving parameters for the at least one binaural rendering filter from the at least one look-up table based on the head rotational angle comprises:

generating a left table pointer index value and a right table pointer index value based on the head rotational angle; and retrieving the parameters for the at least one binaural rendering filter from the at least one look-up table based on the left table pointer index value and the right table pointer index value.

6. The method of claim 1, wherein the at least one binaural rendering filter comprises a shelving filter and a notch filter.

7. The method of claim 6, wherein updating at least one binaural rendering filter based on the head rotational angle comprises updating a gain parameter for each of the shelving filter and the notch filter based on the head rotational angle.

8. The method of claim 1, wherein the at least one binaural rendering filter further comprises an inter-aural time delay filter.

9. The method of claim 8, wherein updating at least one binaural rendering filter based on the head rotational angle comprises updating a delay value for the inter-aural time delay filter based on the head rotational angle.

10. A system for enhancing reproduction of sound comprising:

a headphone assembly including a headband, a pair of headphones, and a digital gyroscope; and a sound enhancement system (SES) for receiving an audio input signal from an audio source, the SES in communication with the digital gyroscope and the pair of headphones, the SES including:

a microcontroller unit (MCU) configured to receive an angular velocity signal from the digital gyroscopes;

calculate a head rotational angle from the angular velocity signal when the angular velocity signal exceeds a predetermined threshold or is less than the predetermined threshold for less than a predetermined sample count;

gradually decrease the head rotational angle when the angular velocity signal is less than a predetermined threshold for more than a predetermined sample count; and a digital signal processor (DSP) in communication with the MCU and including a pair of dynamic parametric head-related transfer function (HRTF) models configured to transform the audio input signal to an audio output signal, the pair of dynamic parametric HRTF models having at least a cross filter, wherein at least one parameter of the cross filter is updated based on the head rotational angle.

11. The system of claim 10, wherein the cross filter comprises a shelving filter and a notch filter and wherein the at least one parameter of the cross filter includes a shelving filter gain and a notch filter gain.

12. The system of claim 10, wherein the pair of dynamic parametric HRTF models further including an inter-aural time delay filter having a delay parameter, wherein the delay parameter is updated based on the head rotational angle.

13. The system of claim 10, wherein the MCU is further configured to calculate a table pointer index value based on the head rotational angle and wherein the at least one parameter of the cross filter is updated using a look-up table according to the table pointer index value.

14. A method for enhancing reproduction of sound comprising:

receiving an audio input signal at a first audio signal interface;

receiving an angular velocity signal from the digital gyroscope mounted to the headphone assembly;

calculating a head rotational angle from the angular velocity signal when the angular velocity signal exceeds a predetermined threshold or is less than the predetermined threshold for less than a predetermined sample count;

updating at least one binaural rendering filter in each of a pair of parametric head-related transfer function (HRTF) models based on the head rotational angle; and transforming the audio input signal to an audio output signal using the at least one binaural rendering filter, the audio output signal including a left headphone output signal and a right headphone output signal.

15. The method of claim 14, wherein the at least one binaural rendering filter comprises a shelving filter and a notch filter, and wherein updating the at least one binaural rendering filter based on the head rotational angle comprises updating a gain parameter for each of the shelving filter and the notch filter based on the head rotational angle.

16. The method of claim 14, wherein the at least one binaural rendering filter further comprises an inter-aural time delay filter, and wherein updating the at least one binaural rendering filter based on the head rotational angle comprises updating a delay value for the inter-aural time delay filter based on the head rotational angle.

17. The method of claim 14, wherein updating the at least one binaural rendering filter based on the head rotational angle comprises retrieving parameters for the at least one binaural rendering filter from at least one look-up table based on the head rotational angle.

18. The method of claim 17, wherein retrieving parameters for the at least one binaural rendering filter from the at least one look-up table based on the head rotational angle comprises:

generating a left table pointer index value and a right table pointer index value based on the head rotational angle; and retrieving the parameters for the at least one binaural rendering filter from the at least one look-up table based on the left table pointer index value and the right table pointer index value.

* * * * *